United States Patent [19]

Davis

[11] Patent Number: 5,029,430

[45] Date of Patent: Jul. 9, 1991

[54] POUCH PACKAGING MACHINE HUMIDITY AND ASEPSIS CONTROL

[75] Inventor: Steven D. Davis, Yucaipa, Calif.

[73] Assignee: W.A. Lane, Inc., San Bernardino, Calif.

[21] Appl. No.: 459,521

[22] Filed: Jan. 2, 1990

[51] Int. Cl.[5] ..... B65B 9/02; B65B 9/20; B65B 55/06; B65B 55/24

[52] U.S. Cl. ..... 53/141; 53/167; 53/554

[58] Field of Search ..... 53/451, 426, 425, 141, 53/167, 551, 552, 554, 555, 373; 422/38, 307, 308; 156/322, 499

[56] References Cited

U.S. PATENT DOCUMENTS

| | | | |
|---|---|---|---|
| 2,166,643 | 7/1939 | Salfisberg | 53/554 X |
| 2,987,859 | 6/1961 | Forth et al. | 53/551 |
| 3,040,490 | 6/1962 | Virta | 53/451 X |
| 3,163,971 | 1/1965 | Löliger et al. | 53/451 X |
| 3,269,079 | 8/1966 | Schmied | 53/451 X |
| 3,445,180 | 5/1969 | Lindh et al. | 53/551 X |
| 3,795,081 | 3/1974 | Brown, Jr. et al. | 53/451 |
| 3,839,126 | 10/1974 | Haller | 156/322 X |
| 3,911,642 | 10/1975 | Ernstsson et al. | 53/451 X |
| 3,953,272 | 4/1976 | Webber | 156/322 X |
| 4,009,551 | 3/1977 | Greenawalt et al. | 53/451 X |
| 4,769,974 | 3/1987 | Davis | 53/433 |

*Primary Examiner*—Horace M. Culver
*Attorney, Agent, or Firm*—Herb Boswell

[57] ABSTRACT

A form, fill and seal pouch packaging machine is augmented by including a heating component for heating the surfaces of its film during product addition. The film is heated to a temperature sufficient to inhibit condensation of hot liquid product on the interior walls of a partly formed pouch during the product addition and/or to achieve asepsis during product addition. The heating member can be positioned in one of several positions adjacent to the surfaces of the film. Irrespective of the positioning of the heating member the surfaces of the film of a partially formed pouch or of the film prior to formation of the pouch is heated to a temperature sufficient to inhibit condensation of vapor on the film and/or to sterilize the surfaces of the pouch.

11 Claims, 2 Drawing Sheets

POUCH PACKAGING MACHINE HUMIDITY AND ASEPSIS CONTROL

BACKGROUND OF THE INVENTION

This invention is directed to an apparatus and process for humidity and asepsis control of films utilized to form pouches on form, fill and seal pouch packaging machines.

A variety of products are packaged in film pouches which are formed, filled and sealed on appropriate pouch packaging machines. These machines utilize continuous rolls of film. A pouch is formed from the film, filled with product and then sealed in a continuous operation.

Earlier utilization of film pouches was restricted to dry products as, for instance, nuts and the like. With increased sophistication of pouch packaging machines, packaging has been extended to include liquid or liquid based products. Currently vast numbers of individual pouches of condiments such as ketchup, mustard and sauces are used on a daily basis in the fast food industry. Other foods stuffs, such as soups and other liquid-solid food mixtures are also being packaged on form, fill and seal pouch packaging machines.

In packaging food stuffs it is necessary to insure that proper sanitation is practiced. In packaging many food items, as for instance, soups or the like, sanitation practice requires that the food item be held at an elevated temperature, just below its boiling point, until such time until is it completely sealed in its package. This protects the food product from contamination by environmental borne pathogens.

While maintaining a liquid containing food stuff at an elevated temperature serves to maintain sterility of the food stuff it complicates the packaging process due to condensation of the liquid on the interior surfaces of the film. The avoidance of liquid condensation is especially critical at the areas where the films are joined together to complete the packaging process.

In my U.S. Pat. No. 4,769,974, assigned to the same assignee as this application, an apparatus and associated process are described for gas purging of the interior of pouches being formed on form, fill and seal pouch packaging machines. The gas purge, among other things, inhibits condensation of the liquid on the interior surfaces of the film prior to sealing of these surfaces together. This patent utilizes gas discharge tubes in conjunction with vacuum tubes for atmospheric purge of the interior of a pouch. Both the gas discharge tubes and the vacuum tubes are located within the interior of the pouch in conjunction with product fill tubes. The product fill tubes are utilized to add the product to the pouch.

As is described in my above identified U.S. Pat. No. 4,769,974 a spreader is utilized to position the product fill tubes and one or the other or both of a gas inlet and a vacuum tube within the interior of a partly formed pouch. While the apparatus and the process of that patent are very utilitarian, with many products for instance, with very thin, hot liquids, large product fill tubes are necessary to inhibit splashing during rapid filling of a pouch. Because the cross section of the interior of a pouch is of a fixed dimension when a relatively large fill tube is utilized little room remains for both a gas addition tube and a gas vacuum tube.

BRIEF DESCRIPTION OF THE INVENTION

In view of the above it is a broad object of this invention to provide for external humidity control devices for pouch packaging machines which do not require the presence of gas addition tubes positioned within a pouch during filling of the same. It is a further object of this invention to provide for external humidity control devices which are positionable in various positions adjacent to surfaces of the film which is being formed into a pouch. Additionally it is an object to also provide for asepsis during product addition and final seal of a pouch.

These and other objects as will be evident from the remainder of this specification are achieved by improving a form, fill and seal packaging machine of the type wherein a pouch is formed from film which is continuously joined about side seams to forms side seals and further joined about a bottom seal prior to being filled with a product and then joined about a top seal to seal the product within the interior of the pouch. The improvement includes a product dispensing means for dispensing product in to said pouch. Further the improvement includes a means for supplying a product containing a hot liquid component therein to the product dispensing means and a film heating means for heating the film to a temperature above the temperature wherein condensation of vapors from the hot liquid product occurs on areas of the film which are joined by seals.

In embodiment of the invention the product dispensing means is positioned within the interior of the pouch and the film heating means is position on the exterior of the pouch in a location in line with and opposed to the product dispensing means.

The film heating means can include a first and/or a second heating component. One of these heating components is positioned with respect to the film along a surface of said film forming the outside of a pouch and the other of the heating components is positioned with respect to the film along a surface of the film forming the inside of a pouch. Further a vacuum means can be located in association with the product dispensing means for creating a aspirate fluid flow adjacent to the product dispensing means.

In an embodiment of the invention the film heating means can include at least one heat duct means for directing gas flow and a hot gas supply means for supplying hot gas to the heat duct means. The heat duct means is located in direct association with the film whereby hot gas supplied to the heat duct means is directed by the heat duct means to the surface of the film to heat the film.

The objects of the invention are further achieved in combination with a form, fill and seal packaging machine of the type wherein a pouch is formed from film which is continuously joined about side seams to forms side seals and further joined about a bottom seal prior to being filled with a product and then joined about a top seal to seal the product within the interior of the pouch, by including an improvement which includes a product dispensing means for dispensing product in to the pouch and a film heating means for heating the film to a temperature greater than at least one of an asepsis temperature and a dew point temperature. The film heating means is located in direct association with the film for heating the film.

The objects of the invention are further achieved in a process of forming a form, fill and seal product containing pouch from continuous film which includes the following steps. First forming side seals in the film at a side seal station. Next advancing the film to a cross seal station. Next forming a cross seal in the film at the cross seal station to form a three sided pouch. Next filling the pouch with product at the cross seal station. And including heating the film to a temperature greater than at least one of an asepsis temperature and a dew point temperature and wherein the heating is conducted prior to or concurrently with the filling step. As so heated the film is hot during and directly after the filling step. Finally the film is advanced and a further cross seal is formed in the film in heated areas of the film. This cross seal seals the pouch. This can be augment by aspirating the interior of the product pouch concurrently with filling the pouch.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the packaging arts will realize that these principles and/or concepts are capable of being utilized in a variety of embodiments which may differ from the embodiments utilized for illustrative purposes herein. For this reason this invention is not be construed as being limited solely to the illustrative embodiments, but should only be construed in view of the claims appended hereto.

DETAILED DESCRIPTION OF THE INVENTION

Figure 1:
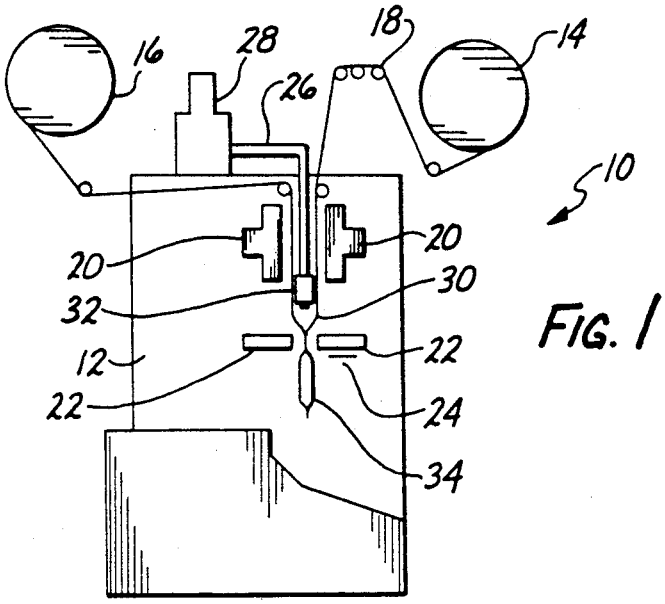
FIG. 1 is a side elevational view of a typical form, fill and seal pouch packaging machine.

FIG. 1 illustrates the basic components of a form, fill and seal pouch packaging machine. The form, fill and seal pouch packaging machine 10 includes a housing 12. Appropriately suspended on the housing 12 is a front roll of film 14 and a rear roll of film 16. Film from the front and rear rolls of film 14 and 16 is fed across feed rollers, collectively identified by the numeral 18 to a position between front and back side seals, collectively identified by the numeral 20. Positioned below and down stream of the side seals 20 are front and back cross seals, collectively identified by the numeral 22. Positioned below and down stream of the cross seals is a cut off knife 24.

A feed tube 26 leads from a product reservoir 28 to a position between the films. The end of the feed tube 26 is suspended within a partially formed pouch generally identified by the numeral 30. The end of the feed tube 26 is located in the pouch 30 by a spreader 32.

Side seams in the descending film from rolls 14 and 16 are formed by the side seals 20. The machine is then indexed moving the film having the side seals therein from the side seal station to the cross seal station. A cross seal is now formed by the cross seal 22. Product can then be added to the partially formed pouch 30 via the feed tube 26 feeding from the reservoir 28. The spreader 32 serves to maintain the pouch in an open configuration about the end of the feed tube 26 and can also serve for holding gas inlet and gas discharge tubes as are described in my above referenced U.S. Pat. No. 4,769,974. For this reason the entire contents of U.S. Pat. No. 4,769,974 are herein incorporated by reference.

Once the partially formed pouch 30 is filled with product, on the next index of the machine the partially formed pouch 30 descends down stream below the cross seal 22. During the next activation of the cross seals 22 a finished pouch 34 is formed. It is removed from the descending stream of pouches being formed on the machine 10 by severing the pouch 34 from the pouch 30 with the cut off knife 24.

Figure 2:
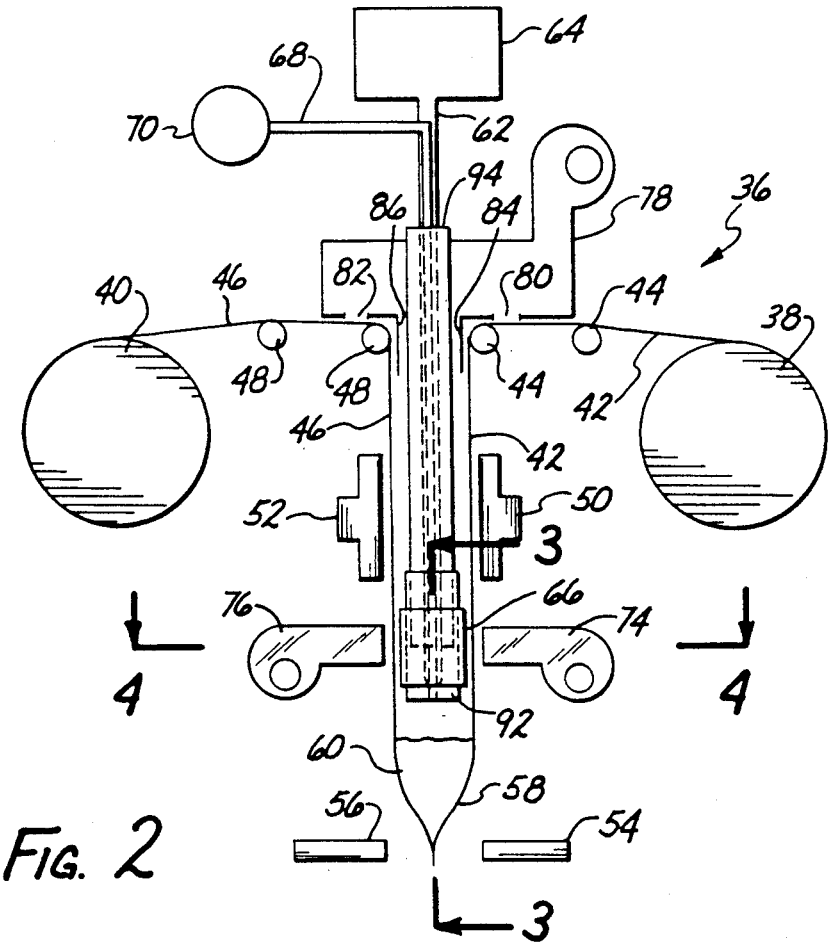
FIG. 2 is a schematic side elevational view of certain components of the form, fill and seal pouch packaging machine of FIG. 1 as well as additional components utilized for the invention herein.

In FIG. 2 certain of the components of the pouch machine 10 of FIG. 1 have been modified to include an external humidity and asepsis control system of the invention. In a manner as per the machine 10 of FIG. 1, a machine 36 includes a front roll of film 38 and a rear roll of film 40. From front roll 38 a front film 42 feeds across feed rollers collectively identified by the numeral 44. From roll 40 a rear film 46 feeds across feed rollers collectively identified by the numeral 48.

The films 42 and 46 pass between front side seal 50 and rear side seal 52 which come together to heat and pressure seal the films 42 and 46 together in a normal manner for a form, fill and seal pouch packaging machine.

Located below the side seals 50 and 52 are front cross seal 54 and rear cross seal 56. The seals 54 and 56 come together to form a seal which is severed to form the bottom seal on an uppermost package and the top seal on a lowermost package.

Figure 3:
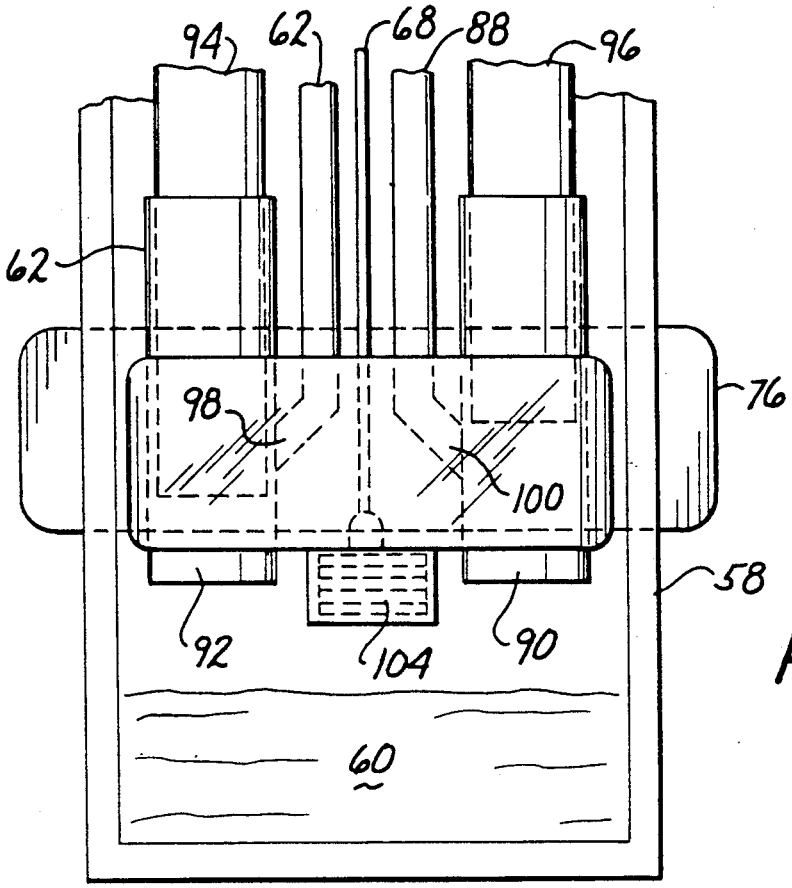
FIG. 3 is a front elevational view of a portion of a pouch, a fill head and a heating device utilized in the invention.
Figure 4:
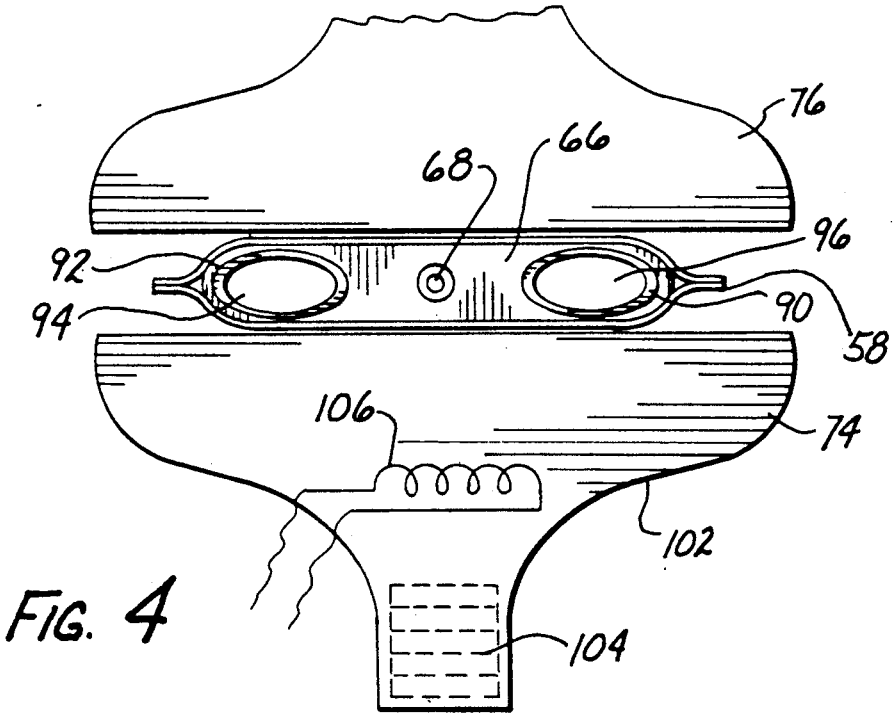
FIG. 4 is a top plan view about the line 4—4 of FIG. 2.

In FIG. 2 a partially formed pouch 58 includes side seams formed by the side seals 50 and 52 and a bottom seam formed by the cross seals 54 and 56. Product 60 has been added via two fill tubes. One of these fill tubes, tube 62 is identified in FIG. 2. The other fill tube, seen in FIGS. 3 and 4, is identified below. Both of the fill tubes, tube 62 (and its below identified mate) lead from a product reservoir 64. The fill tube 62 (and its below identified mate) are suspended within the interior of the partially formed pouch 58 via a spreader 66. Also located in the spreader 66 is a vacuum line 68 which leads from a vacuum (or aspirate) source 70. Further attached to the spreader 66 and extending upwardly between the films 42 and 46 are control mechanisms, identified below, used for control of product addition to the pouch 58.

Assuming that the product 60 being added to the partially formed pouch 58 is a hot thin liquid which is at or near its boiling point, it is desirable to construct the exit orifice of the fill tube 62 (and it below identified mate) such that they have a large cross sectional area. This allows for rapid adding of the product 60 to the partially formed pouch 58 without undue splashing. Further, for very thin products it is also desirable to have control valves (also described below) for the fill tubes as close as possible to the bottom most end of the fill tubes to further inhibit splashing of the product within the pouch 58.

If splashing occurs within the interior of the pouch 58 product could become lodged on those interior surface areas of the pouch 58 which ultimately will be positioned between the cross seals 54 and 56. The formation of a cross seal between films which are contaminated with product is undesirable insofar as material can be incorporated within the seal itself. This can result in improperly formed seals which leak. A leaking seal within a pouch renders the pouch useless and it must be scrapped. This detracts from the economics of operation of a form, fill and seal pouch packaging machine.

In addition to contamination by splashing, the area of the films 42 and 46 which will be sealed to form the cross seal can also be contaminated by condensation of product vapors. Such vapor can condense on the interior surfaces of the films 42 and 46.

As is described in my above referenced U.S. Pat. No. 4,769,974 one way to inhibit condensation is to flush the interior of a partially filled pouch with a dry gas. However, if very large fill tubes are utilized, sometimes there is insufficient space on the spreader for location of both gas inlet and gas vacuum tubes.

The product reservoir 64 is selected as a means to contain a hot liquid based product. Further it is selected to maintain such a liquid based product at an elevated temperature. The fill tube 62 (and it below identified mate and control mechanisms) are selected as a means to dispense that hot product to the pouch 58.

As a consequence of adding hot product 60 to the pouch 58 hot vapors will also be introduced within the pouch 58. If these hot vapors come in contact with a cool surface they will condense. To inhibit the condensation of hot product vapor on the interior surfaces of the films 42 and 46 and also to provide for aseptic conditions within the interior of the partially formed pouch 58, the surfaces of the films 42 and 46 are be heated. By heating the surface of the films 42 and 46 vapor condensation within the pouch 58 is inhibited. It is to be understood that such vapor inhibiting heating is independent from any heating by the seals 50, 52, 54 or 56 during sealing of the films 42 and 46 together.

In a first embodiment of the invention a heating means is provided to heat the films 42 and 41 in an area proximal to the spreader 66. Thus front and back heating components 74 and 76 are provided adjacent to the outside surfaces of films 42 and 46 in a position horizontally opposed to the spreader 66.

As representative in FIG. 2, the heating components 74 and 76 are "squirrel cage" heaters. As discussed below, these would included a fan and an electrical resistant heating element located therein. It is recognized that other heating means such as gas fired heating elements or resistance heating elements equipped with reflectors or other like devices could be used as alternates to the heating components 74 and 76 illustrated.

In practicing the invention the films 42 and 46 are heated above the dew point of the hot liquid component of the product 60. This prevents condensation of that liquid on the inside surfaces of the partially formed pouch 58, especially in those areas wherein the cross seal will be formed. Normally the area most susceptible to condensation would be the inside surfaces of the pouch 58 (the inside surfaces of the films 42 and 46) immediately adjacent the spreader 66. Thus, as illustrated in FIG. 2, the heating components 74 and 76 are located on the outside surfaces of the films 42 and 46 immediately external of the spreader 66. The heating components are located on opposite side of the spreader 66 in opposition to one another, i.e. oriented towards one another.

In addition to the heating components 74 and 76, or in substitution thereof, a manifold heating element 78 is located around the fill tubes and their control mechanism identified below and over the surface of the films 42 and 46 above the rollers 44 and 48. The manifold heating element 78 provides for discharge of hot gas through vents 80 and 82. The vents 80 and 82 are directed on to the inside surfaces of the films 42 and 46. The inside surface of the films 42 and 46 are thus heated upstream from and just prior to passage of the films 42 and 46 between the side seals 50 and 52.

Additionally, the manifold heating element 78 can include flanges 84 and 86 which are positioned interior of the rollers 44 and 48 immediately adjacent to the inside surfaces of the films 42 and 46. The flanges 84 and 86 are spaced from the fill tube 62, the vacuum line 68 and other components leading to the spreader 66. This provides a gas inlet from the manifold 78 to the area between the films 42 and 46 allowing for direct introduction of hot gases from the manifold 78 into the space between the films 42 and 46.

The vacuum line 68 provides aspirate vacuum below the spreader 66. When used in conjunction with the vacuum line 68 hot gas introduced via the flanges 84 and 86 is aspirated downwardly between the spreader 66 and the interior surfaces of the films 42 and 46. This hot gas serves to inhibit condensation of the hot liquid component of the product 60.

It is further recognized that the manifold heating element 78 via the flanges 84 and 86 and/or vents 80 and 82 can be used in conjunction with the external heating components 74 and 76 to provide for maximum inhibition of condensation within the interior of the partially formed pouch 58. Thus in conjunction with the surfaces of the films 42 and 46 being raised to an elevated temperature, hot gas from the manifold 64 is aspirated between the spreader and the inside surface of the pouch 58 to the vacuum line 68.

According to a process of the invention sufficient external heating is provided to inhibit condensation within the interior of a partially formed product pouch by heating the surface of the films 38 and 40 above the dew point of the liquid of the product being added to the pouch and/or by providing for hot purge air from the manifold 78. Heating of the surfaces of the film raises those surface above the dew point of the hot liquid component of the product. The hot air purge not only heats the film surfaces but also depress the dew point of the gases within the interior of the pouch 58 by removing the product vapors.

It is evident that the process of the above paragraph can be achieved either by providing external heating components which directly heat the films 42 and 46 or by providing for hot manifold gases which are channeled between the films 42 and 46. Both of these serve to inhibit vapor condensation on the interior surfaces of the films 42 and 46.

FIGS. 3 and 4, respectively, show an elevational view and a plan view of that area of FIG. 2 across the spreader 66 and the heating components 74 and 76. As is evident from FIGS. 3 and 4, the spreader 66 incorporates a left side fill tube, fill tube 62 discussed above in reference to FIG. 2, and its mate, right side fill tube 88.

As seen in FIG. 4, outlet nozzles 90 and 92 connected to the fill tubes 62 and 88 extend almost to the side edges of the spreader 66. This results in the nozzles 90 and 92 having a large cross sectional area. Because of the large cross sectional area of the nozzles 90 and 92 and because these nozzles are postioned almost to the outside edges of the spreader 66 there is insufficient room in the spreader 66 outboard of the nozzles 90 and 92 to locate a gas inlet tube as was utilized in the invention of U.S. Pat. No. 4,769,974.

As is shown in FIG. 3, the left fill tube 62 supplies product to the left nozzle 92, and the right fill tube 88 supplies product to the right nozzle 90. A left control plunger 94 fits into the left nozzle 92 and in a like manner a right control plunger 96 fits into the right nozzle 90.

In FIG. 3 the left plunger 94 is illustrated in a positioned below opening 98 of the left fill tube 62. This seals the left fill tube 62 such that no product is transferred from the tube 62 into the nozzle 92 for ultimate discharge into the pouch 58. Contrary to this also for illustrative purposes the right plunger 96 is shown in a raised position. In the raised position product from the right fill tube 88 is transferred through opening 100 for discharge of product via the right nozzle 90 into the interior of the pouch 58. It is, of course, recognized that in actual operation of a form, fill and seal packaging machine incorporating the invention, the plungers 94 and 96 would operate in concert, both concurrently either opening their respective fill tube 62 and 88 or closing the same.

Centrally located in the spreader 66 is the vacuum line 68. When used in conjuction with the manifold heater 78 aspirate aspirated into the vacuum line 68 would draw warm air from the manifold 78 in between the films 42 and 46 into the partially formed pouch 58 to inhibit condensation on the interior surfaces of the pouch 58.

As shown in FIG. 4 the heating component 74 has a large flared duct 102 to spread hot air across the totality of a side of the partially formed pouch 58. A squirrel cage blower 104 moves air across heating elements 106 to heat the air. The hot air is then discharged from the duct 102 against the outside surface of the partially formed pouch 58.

For the purposes of this invention the word "duct" is constructed to included not only the flared duct 102 of the heating component 74 (and it opposing component 76) but also the heating manifold 78. Thus a "duct" serves as the means for directing hot gas as illustrated by the flared duct 102 of the component 74 described above or as illustrated by the manifold 78.

It is evident that the heating devices of the invention can serve not only to inhibit condensation within the interior of a partially formed pouch but also can serve to maintain or create aseptic conditions in the interior of the pouch until it is sealed and isolated from the ambient environment. Such use to maintain aseptic conditions can be practiced not only with liquid based products, but also with dry products wherein it is mandatory to maintain the sterility of these products during the form, fill and seal operations of the pouch packaging machine. To achieve such aseptic conditions the films 42 and 46 are heated to a temperature above that necessary to achieve asepsis.

It is further evident from FIG. 3 that by using the external heating of the invention it allows for location of the product control valves, i.e. the plungers 94 and 96 and openings 98 and 100, to be directly adjacent to the area of the pouch 58 wherein the product will be deposited. This serves to further inhibit splashing of product while still allowing for rapid addition of the product to the pouch 58.

I claim:

1. In combination with a form, fill and seal packaging machine of the type wherein a pouch is formed from front and back films that are continuously joined with side seal forming means to form side seals and further joined with a cross seal forming means to form a bottom seal prior to being filled with a product and then joined with said cross seal forming means to form a top seal to seal the product within the interior of the pouch, an improvement which comprises:

product dispensing means for dispensing product into said pouch, said product dispensing means including a spreader and at least one product fill tube, said product fill tube having an outlet nozzle located on said spreader for discharging product to the interior of said pouch, said spreader and said outlet nozzle located below said side seal forming means and above said cross seal forming means within the interior of a pouch being formed on said packaging machine;

means for supplying a product containing a hot liquid component therein to said product fill tube; and a first film heating means for heating said film to a temperature above the temperature wherein condensation of vapors from said hot liquid product occurs on areas of said film which are joined to form said top seal, said first film heating means located exterior of said pouch adjacent the outside surface of said both said front and back films and in a location in line with and opposed to said spreader whereby the surfaces of both said front and back films adjacent said spreader are heated to said temperature above wherein condensation of vapor occurs.

2. The combination of claim 1 further including:

a second film heating means, said second film heating means being positioned upstream from said side seal forming means adjacent the surfaces of said front and back films that will form the inside of said pouch.

3. The combination of claim 1 including:

vacuum means located in association with said product dispensing means for creating an aspirate fluid flow between said spreader and the surfaces of said front and back films within the interior of a pouch being formed on said packaging machine.

4. The combination of claim 1 wherein:

said first film heating means includes a front heat duct means and a back heat duct means, said front heat duct means and said back heat duct means for directing gas flow against the outside surfaces of said front and back films respectively, said first film heating means further including hot gas supply means for supplying hot gas to said front and back heat duct means, said front and back heat duct means located in direct association with said front and back films at a location directly in line with said spreader whereby hot gas supplied to said front and said back heat duct means is directed by said front and said back heat duct means to the surface of said front and back films to heat said front and back films.

5. The combination of claim 4 including:

vacuum means located in association with said product dispensing means for creating an aspirate fluid flow between said spreader and the surfaces of said front and back films within the interior of a pouch being formed on said packaging machine.

6. The combination of claim 4 further including:

a second film heating means, said second film heating means being positioned upstream from said side seal forming means adjacent the surfaces of said front and back films that will form the inside of said pouch; and said second film heating means includes a manifold means for directing gas flow and a further hot gas supply means for supplying hot gas to said manifold means, said manifold means being located in direct association with said film at said position upstream from said side seal forming means whereby hot gas supplied to said manifold means is directed by said manifold means to the inside surface of said front and back films to heat said front and back films prior to joining said film with said side seal forming means.

7. In combination with a form, fill and seal packaging machine of the type wherein a pouch is formed from front and back films that are continuously joined with side seal forming means to form side seals and further joined with a cross seal forming means to form a bottom seal prior to being filled with a product and then joined with said cross seal forming means to form a top seal to seal the product within the interior of the pouch, an improvement which comprises:

product dispensing means for dispensing product into said pouch, said product dispensing means including at least one product outlet nozzle;

film heating means for heating said front and back films to a temperature greater than at least one of an asepsis temperature and a dew point temperature;

said film heating means including a gas manifold for directing hot gas flow and a manifold heat supply means for supplying hot gas to said gas manifold;

said gas manifold located in direct association with said film at a position upstream from said side seal forming means whereby hot gas supplied to said gas manifold is directed by said gas manifold to the inside surface of said front and back films to heat said front and back films prior to joining said film with said side seal forming means.

8. The combination of claim 7 wherein:

said gas manifold includes at least one heat duct positioned between said front and back films for directing gas flow between said front and back films;

said heat duct located in direct association with said front and back films; and wherein hot gas is supplied to said heat duct through said gas manifold and is directed by said heat duct between said films towards said product discharge means to heat said front and back films to said temperature that is greater than said at least one of an asepsis temperature and a dew point temperature.

9. The combination of claim 8 including:

vacuum means located in association with said product dispensing means for creating an aspirate fluid flow adjacent to said product dispensing means.

10. The combination of claim 8 further including:

an external film heating means, said external film heating means including a front heat duct means and a back heat duct means, said front heat duct means and said back heat duct means for directing gas flow against the outside surfaces of said front and back films respectively, said external heating means further including hot gas supply means for supplying hot gas to said front and back heat duct means;

said front and back heat duct means being located in association with said front and back films at a position exterior of said pouch and proximal to said product outlet nozzle whereby hot gas supplied to said front and said back heat duct means is directed by said front and said back heat duct means to the surface of said front and back films to heat said front and back films.

11. The combination of claim 8 further including:

vacuum means located in association with said product dispensing means for creating an aspirate fluid flow within inside of said pouch.

* * * * *